US007137396B2

(12) United States Patent
Okane

(10) Patent No.: US 7,137,396 B2
(45) Date of Patent: Nov. 21, 2006

(54) FALSE NAIL REMOVAL DEVICE AND METHOD

(76) Inventor: Bernadette Okane, 306 W. Ridge Mews, Woodridge, NJ (US) 07075

( * ) Notice: Subject to any disclaimer, the term of this patent is extended or adjusted under 35 U.S.C. 154(b) by 220 days.

(21) Appl. No.: 10/872,729

(22) Filed: Jun. 21, 2004

(65) Prior Publication Data

US 2005/0279376 A1 Dec. 22, 2005

(51) Int. Cl.
*A45D 29/00* (2006.01)
*A61C 15/04* (2006.01)

(52) U.S. Cl. ..... 132/200; 132/73; 132/323; 132/325

(58) Field of Classification Search ..... 132/73, 132/200
See application file for complete search history.

(56) References Cited

U.S. PATENT DOCUMENTS 906,651 A * 12/1908 Nichols ..... 132/75
1,533,664 A * 4/1925 Sanford ..... 132/73
1,816,876 A * 8/1931 Soreny ..... 132/75
5,921,250 A * 7/1999 Rhea et al. ..... 132/74.5
6,305,383 B1 * 10/2001 Thoma ..... 132/200
6,758,220 B1 * 7/2004 Willis ..... 132/200
6,901,935 B1 * 6/2005 Chang ..... 132/75
2004/0025896 A1 * 2/2004 Tsukamoto ..... 132/74.5

FOREIGN PATENT DOCUMENTS

JP 2004321586 A * 11/2004

* cited by examiner

*Primary Examiner*—Todd E. Manahan
(74) *Attorney, Agent, or Firm*—Ezra Sutton, Esq.

(57) ABSTRACT

A method of removing a false nail from a person's natural fingernail including the steps of pushing the cuticle away from the base of the false nail to expose the base of the false nail; placing a taut string to engage the base of the false nail to be removed; applying pressure to the base of the false nail using the taut string to break part of the adhesive bond between the false nail and the person's natural fingernail; and manipulating the taut string between the false nail and the natural fingernail by moving the taut string from the base of the false nail toward the tip of the false nail in order to continue to break the adhesive bond between the false nail and the natural fingernail in order to remove the false nail.

10 Claims, 12 Drawing Sheets

FALSE NAIL REMOVAL DEVICE AND METHOD

FIELD OF INVENTION

The present invention relates to a false fingernail removal method and device. More particularly, this novel method removes false nails without the use of solvents or cleaning soaps.

BACKGROUND OF THE INVENTION

For the past 25 years, the removal of false fingernails by manicurists or by consumers have used chemical solvents such as acetone, alcohol, DSMO and the like or have used cleaning detergents such as liquid soaps and the like. These previous methods are typically time consuming and dangerous, as the users are exposed to harmful fumes from the solvents.

There remains a need for a false nail removal method and device that permits the user to remove a false nail from a user's natural fingernail without the use of chemical solvents.

DESCRIPTION OF THE PRIOR ART

False nail removal methods and devices have been disclosed in the prior art. For example, U.S. Pat. No. 5,921,250 to Rhea et al. discloses an artificial nail remover method comprising an inner chamber containing hot water for heating solvent in at least one outer chamber or basin. The inner chamber can have a vibrator motor driven by a rechargeable battery for agitating the solvent for removal of false nails from fingernails. This prior art patent does not disclose or teach the method or structure of the present invention for removing a false nail from a person's natural fingernail.

U.S. Pat. No. 5,609,166 to Walker discloses a fingernail removing device adapted to remove false fingernails from the user comprising a plastic integrally molded rectangular container body with an inner bristle housing secured and supported by a plurality of integral rib members. The inner bristle housing has a chamber with an opening of sufficient width to receive a plurality of fingers with one wall of the bristle housing containing a sectioned flexible brush assembly. The flexible brush assembly comprises at least two separate sections of bristles, each section of bristles comprising a plurality of spaced bristle members extending inward from the inner surface of the bristle housing wall into the chamber and defining a curved passageway allowing a plurality of fingers to pass therethrough while allowing the fingers to engage the bristle members, and a cover removably mounted to the container. This prior art patent does not disclose or teach the method or structure of the present invention for removing a false nail from a person's natural fingernail.

U.S. Pat. No. 5,388,597 to Smith discloses an artificial fingernail remover and brush cleaner device. A cylindrical container of acetone has a lower housing and an upper housing with an aperture. A finger is dipped from the larger aperture for removal of a false fingernail. A brush with a handle is trapped in the larger aperture for cleaning without touching the bottom. This prior art patent does not disclose or teach the method or structure of the present invention for removing a false nail from a person's natural fingernail.

None of the aforementioned prior art patents disclose or teach the method or the structure of the present invention of a false nail removal device and method thereof.

Accordingly, it is an object of the present invention to provide a false nail removal method and device that permits the user to remove a false nail from a user's natural fingernail without the excessive use of force and without the use of harmful chemical solvents. Another object of the present invention is to provide for a false nail removal method and device that is not harmful to the user's natural fingernail during the removal of the false nail.

Another object of the present invention is to provide for a false nail removal method and device that is time efficient, cost effective and easy to use. Salons, manicurists, and nail removers will increase productivity which will increase profitability of their operations.

Another object of the present invention is to provide for a false nail removal method and device that is painless, effortless, convenient and quick when removing a false nail.

Another object of the present invention is to provide for a false nail removal method and device that is capable of removing false nails that have been bonded to the user's natural fingernail by glue, cement gels, acrylics, adhesives and the like.

Another object of the present invention is to provide for a false nail removal method and device that is capable of being used over and over again.

A further object of the present invention is to provide for a false nail removal method and device that can be mass-produced in an automated and economical manner and is readily affordable to the user.

SUMMARY OF THE INVENTION

In accordance with the present invention, there is provided a method of removing a false nail from a person's natural fingernail including the steps of pushing the cuticle away from the base of the false nail to expose the base of the false nail; placing a taut string to engage the base of the false nail to be removed; applying pressure to the base of the false nail using the taut string to break a part of the adhesive bond between the false nail and the person's natural fingernail; and manipulating the taut string between the false nail and the natural fingernail by moving the taut string from the base of the false nail toward the tip of the false nail in order to continue to break the bond between the false nail and the natural fingernail in order to remove the false nail.

The present invention alternatively provides for a method of removing a false nail from a person's natural fingernail including the steps of pushing the cuticle away from one side section of the false nail to expose the one side section of the false nail; placing a taut string to engage the one side section of the false nail to be removed; applying pressure to one side section of the false nail using the taut string to break a part of the adhesive bond between the false nail and the person's natural fingernail; and manipulating the taut string between the false nail and the natural fingernail by moving the taut string from the one side section of the false nail toward the tip and then toward the other side section of the false nail in order to continue to break the adhesive bond between the false nail and the natural fingernail in order to remove the false nail.

The present invention also provides for a false nail removal device for removing a false nail from a person's natural fingernail. The false nail removal device includes a handle section having a proximal end and a distal end. The handle section includes a string reservoir/compartment thereon, wherein the string reservoir/compartment is used for holding a supply of string. The distal end includes a pair of spaced-apart prongs for mounting a section of the string thereon for engaging and removing a false nail from a person's natural fingernail. The handle section also includes a tightening member thereon for tightening an end section of the string in order to create a taut section of the string between the spaced-apart prongs.

The present invention further provides for a false nail removal device for removing a false nail from a person's natural fingernail for use by a professional or consumer. The false nail removal device includes an anchor member having a proximal end and a distal end and the anchor member includes a passageway opening for receiving a user's finger therethrough. The anchor member includes an outer surface wall having a circumferential groove therein for winding a portion of string thereto. The false nail removal device also includes a gripper member having a pair of gripper sections and each of the gripper sections includes an outer surface wall and an inner surface wall. Each of the said inner surface walls includes a centrally located tab opening for receiving a slotted rod having a string slot therein and the string slot of the slotted rod is for receiving an end section of the string therethrough. The outer surface walls of the gripper member are for gripping by the user's hand in order to tighten the string in order to create a taut section of the string between the anchor member and the gripper member. The taut section of the string is for engaging and removing a false nail from a person's natural fingernail.

Additionally, the present invention also provides for a false nail removal device for removing a false nail from a person's natural fingernail for use by a skilled professional. The false nail removal device includes a first gripper member having a pair of first gripper sections and each of the first gripper sections includes an outer surface wall and an inner surface wall. Each of the inner surface walls of the first gripper sections includes a centrally located tab opening for receiving a first slotted rod having a first string slot therein and the first string slot of the first slotted rod is for receiving a first end section of a string therethrough. The false nail removal device also includes a second gripper member having a pair of second gripper sections and each of the gripper sections includes an outer surface wall and an inner surface wall. Each of the inner surface walls of the second gripper sections also includes a centrally located tab opening for receiving a second slotted rod having a second string slot therein and the second string slot of the second slotted rod is for receiving a second end section of the string therethrough. The outer surface walls of the first and second gripper members is for gripping by the user's hands for tightening the string in order to create a taut section of the string between each of the first and second gripper members. The taut section of said string for engaging and removing a false nail from a person's natural fingernail.

BRIEF DESCRIPTION OF DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED AND ALTERNATE EMBODIMENTS

Figure 1:
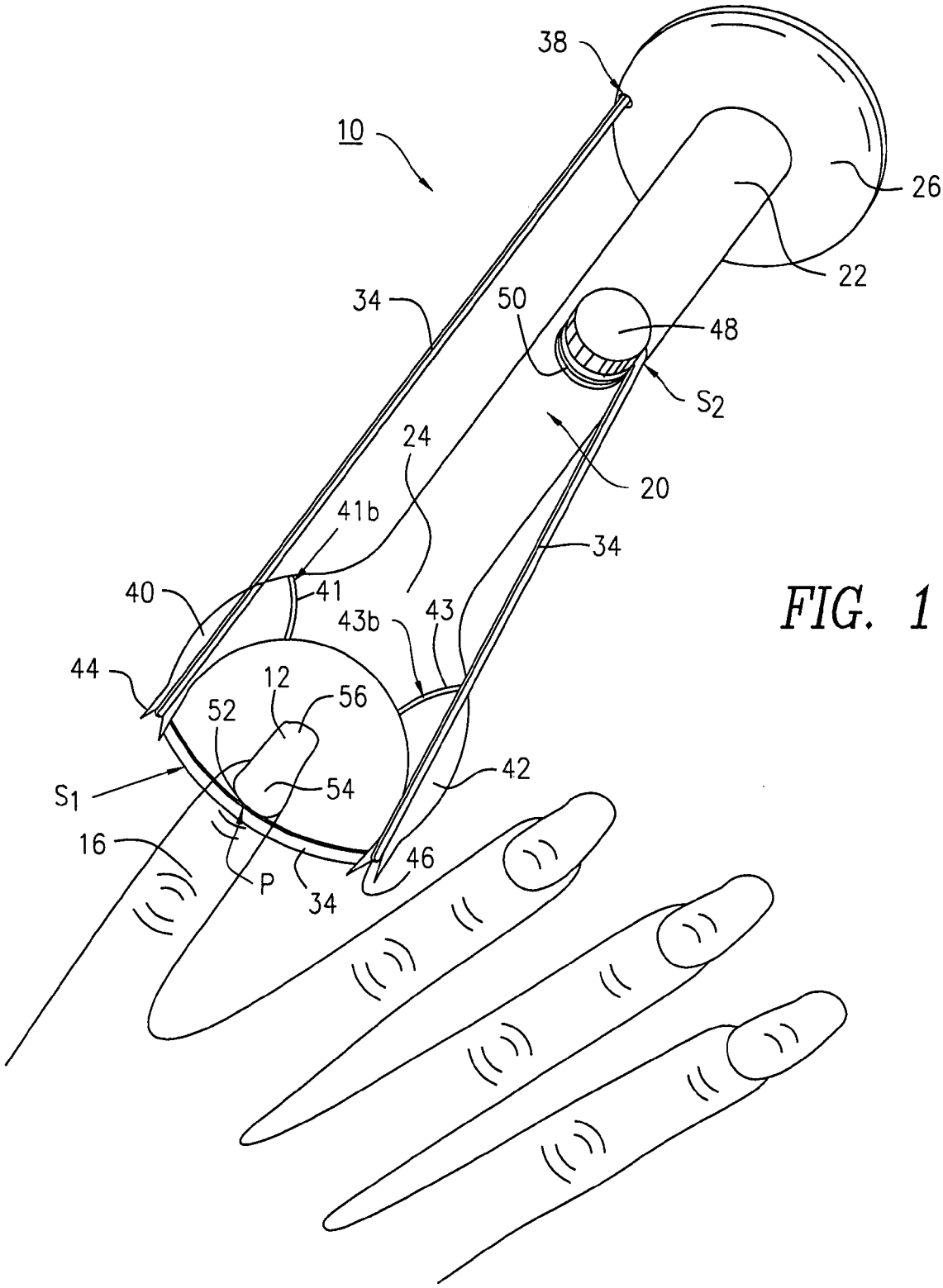
FIG. 1 is a top perspective view of the false nail removal device of the preferred embodiment of the present invention showing the device in an assembled state and in an operational mode.

The false nail removal device 10, 100 and 200 and their component parts are represented in detail by FIGS. 1 through 10 of the patent drawings. The false nail removal devices 10, 100 and 200 are used for removing a false nail 12 from a person's natural fingernail 14 on a finger 16 without having to use chemicals (solvents and the like) or soaking techniques (soaps and the like) for the false nail removal.

Figure 2:
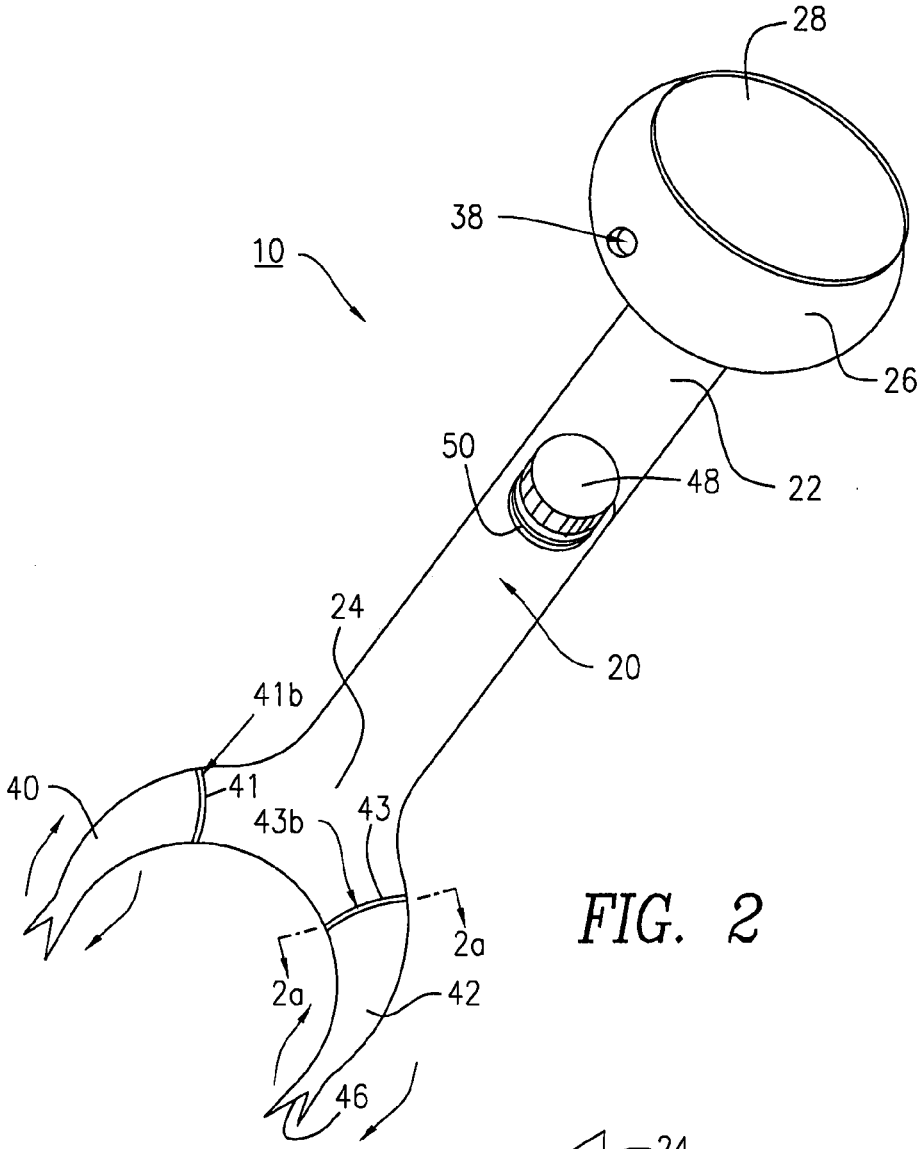
FIG. 2 is a perspective view of the false nail removal device showing a string reservoir compartment, the handle section and the pair of spaced-apart prongs.
Figure 2A:
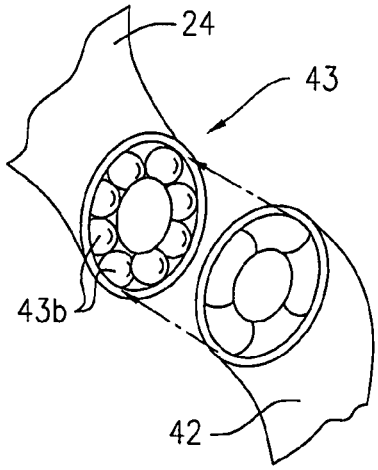
Figure 3:
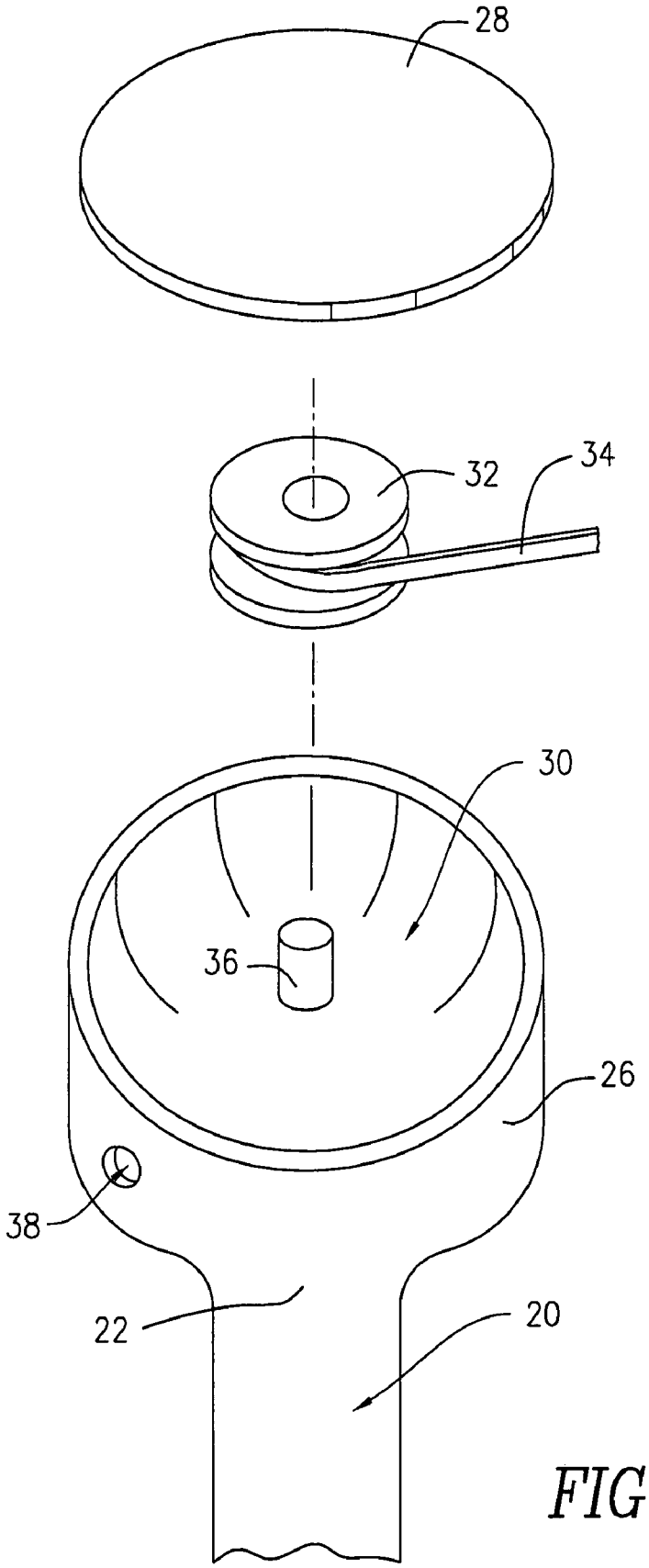
FIG. 3 is an exploded perspective view of the false nail removal device showing a top cover and an interior cavity of the string reservoir/compartment having a spool member of flat string thereon.

The false nail removal device 10 is for a user's personal use, as shown in FIGS. 1 to 3. The false nail removal device 10 includes a handle section 20 having a proximal end 22 and a distal end 24. The handle section 20 at its proximal 22 includes a string reservoir/compartment 26 being internally attached thereto. The string reservoir/compartment 26 includes a top cover 28 and an interior cavity 30 for holding a spool member 32 of flat string 34 therein. The interior cavity 30 includes a spool tab 36 for dispensing of the flat string 34 from the spool member 32. The string compartment 26 includes an opening 38 for receiving the flat string 34 therethrough, as shown in FIGS. 2 and 3 of the drawings. The flat string 34 can be made of cotton, rayon, nylon, polyester, cotton-polyester, polytetrafluoroethylene (Teflon™), polyparaphenylene terephthalamide (Kevlar™) or other flexible plastics. Alternatively, the flat string 34 can have a circular cross-sectional shape, as in surgical wire.

Figure 1A:
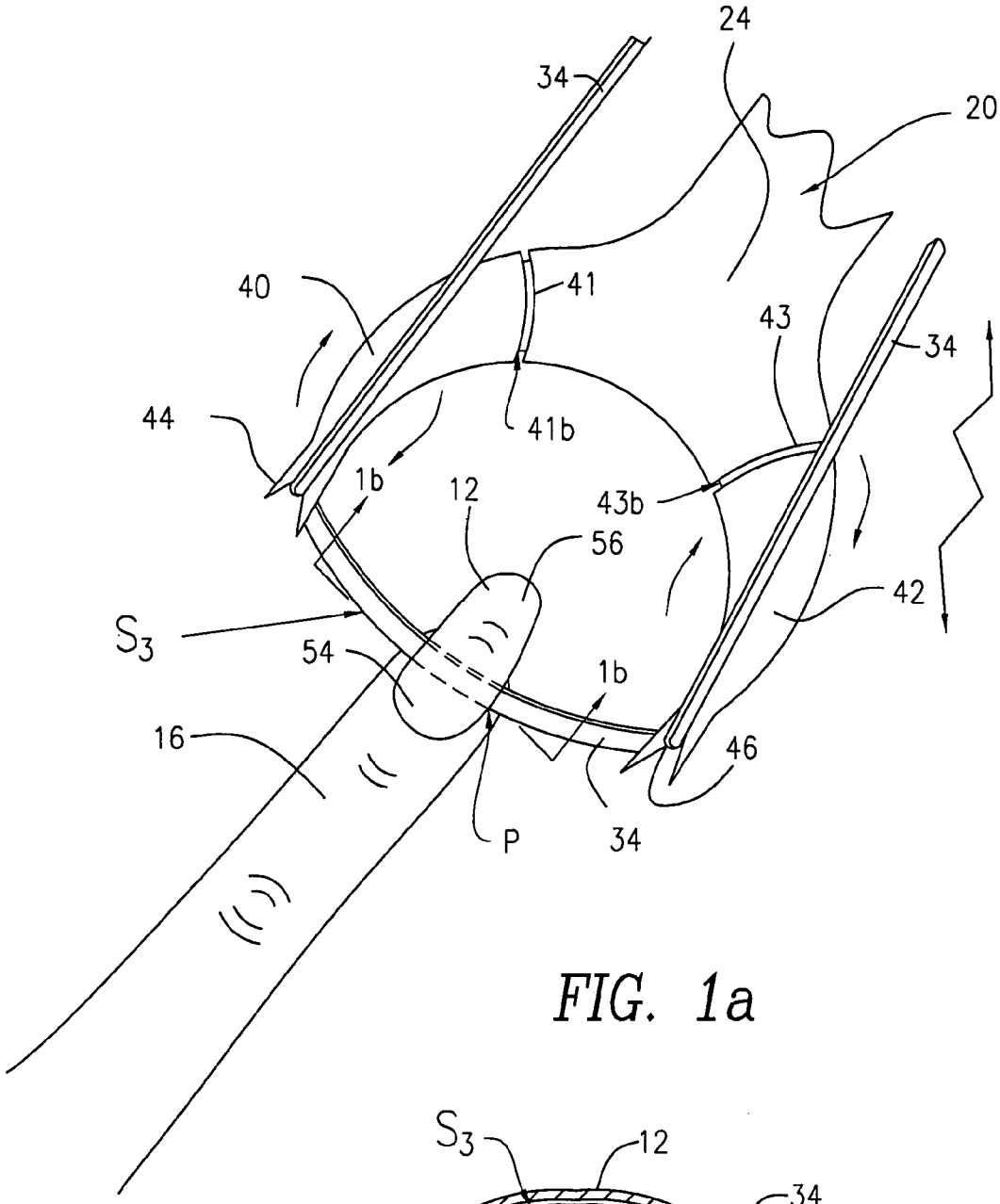
FIG. 1*a* is an enlarged top perspective view of the false nail removal device showing a taut string section ($S_3$) of a flat string between a pair of spaced-apart prongs at its distal end of a handle section.

The handle section 20 at its distal end 24 includes a pair of spaced-apart prongs 40 and 42, each having a V-notched groove 44 and 46, respectively, thereto. Each of the V-notched grooves 44, 46 are for receiving a string sections $S_1$ of the flat string 34 thereon for engaging and removing a false nail 12 from a person's natural fingernail 14, as depicted in FIGS. 1 and 1*a* of the drawings. Further, the spaced-apart prongs 40, 42 includes pivoting joint members 41 and 43 respectively, each having a ball bearings 41*b* and 43*b* therein. The pivoting joint members 41, 43 enable each of the spaced-apart prongs 40, 42 to move in various directions, including up and down, side-to-side, and to rock independently relative to each other. This movement of prongs 40, 42 provides the user with a way to accommodate any nail shape or size of finger while removing the false nail 12 on the customer.

Figure 1B:
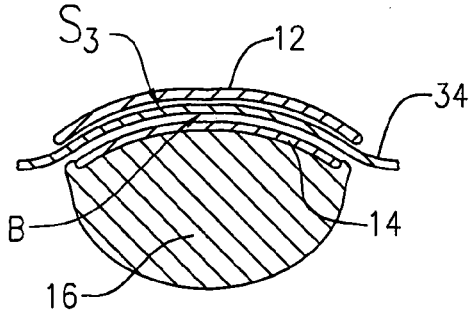
FIG. 1*b* is a cross-sectional view of the false nail removal device taken along line 1*b*—1*b* of FIG. 1*a* in the direction of the arrows showing the flat string separating a false nail from a user's natural fingernail.

The handle section 20 further includes a rotatable tightening member 48 (in the form of a round knob) for tightening an end section $S_2$ of the flat string 34 in order to create a taut string section $S_3$ of the flat string 34 between the V-notched grooves 44, 46 of prongs 40, 42, respectively, as shown in FIGS. 1*a* and 1*b* of the drawings. The rotatable tightening member 48 in the form of a knob includes a circumferential channel 50 for wrapping of the flat string 34 around the tightening member 48, as depicted in FIG. 1. The handle section 20 is made of a durable plastic material or a lightweight metal material, such as aluminum or stainless steel.

In operation, as shown in FIGS. 1, 1*a* and 1*b*, the user operates the false nail removal device 10 in the following manner. The user initially pushes her cuticle 52 away from a base section 54 of the false nail 12 in order to expose the base section 54 of the false nail 12 (see FIG. 1). The user then places the taut string section $S_3$ of flat string 34 to engage the base section 54 of the false nail 12 to be removed, as shown in FIG. 1*a*. Next, the user applies pressure P to the base section 54 of the false nail 12 using the taut string section $S_3$ of flat string 34 to break the adhesive bond B between the false nail 12 and the user's natural fingernail 14, as shown in FIG. 1*b*. The user (in her last operational step) then manipulates the taut string section $S_3$ of flat sting 34 in a zigzag fashion between the false nail 12 and user's natural fingernail 14 by moving the taut string section $S_3$ of flat string 34 from the base section 54 of the false nail 12 toward an end tip 56 of the false nail 12 in order to break the bond B completely between the false nail 12 and the user's natural fingernail 14 in order to remove the false nail 12. The user then repeats the aforementioned steps to remove other false nails 12 from the user's natural fingernails 14.

Alternatively, the user can start the nail removal process starting with the tip 56 of the false nail 12, as sometimes the tip 56 of the false nail 12 has begun to lift-off from the customer's natural nail 14. The operator simply inserts the flat string 34 where the false nail 12 has lifted-off the customer's natural nail 14 and begins the false nail removal process at the tip 56, such that the flat string 34 is then maneuvered towards the base section 54 of the false nail 12 and towards the cuticle 52 of the natural nail 14 on the customer's finger 16. Additionally, if the false nail 12 has not begun to lift-off, the manicurist can make a slight slit or indent between the false nail 12 and the natural nail 14 in order to insert the flat string 34 to start the false nail removal process, as previously mentioned in the above.

FIRST ALTERNATE EMBODIMENT

Figure 4:
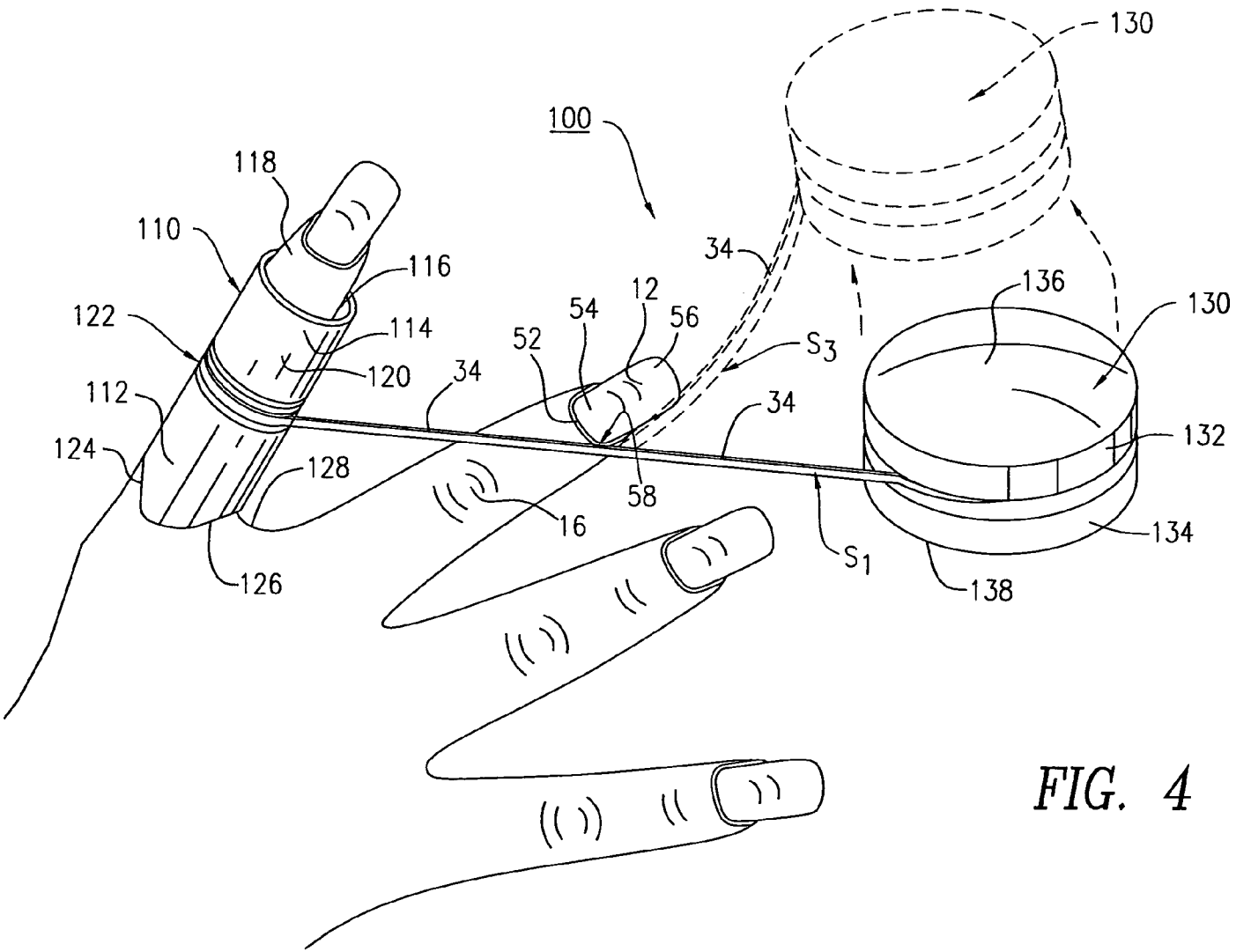
FIG. 4 is a top perspective view of the false nail removal device of the first alternate embodiment of the present invention showing the device in an assembled state and in an operation mode.
Figure 5:
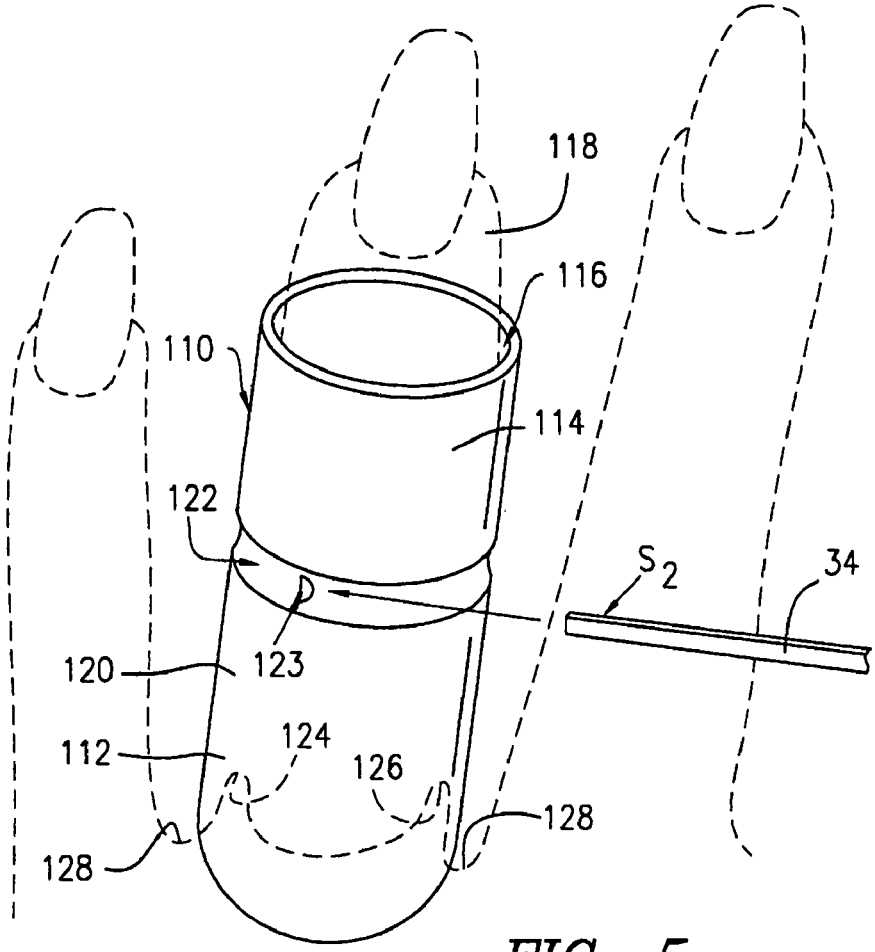
FIG. 5 is an enlarged perspective view of the false nail removal device showing an anchor member having a circumferential groove thereon.

The false nail removal device 100 is for a user's personal use or for professional use by a manicurist, as shown in FIGS. 4 to 7. The false nail removal device 100 includes an anchor member 110, and a gripping member 130. The anchor member 110, as shown in FIGS. 4 and 5, includes a proximal end 112 and a distal end 114, being substantially cylindrical in shape. The anchor member 110 includes a passageway opening 116 for receiving a user's finger 118 therethrough. The anchor member 110 also includes an outer surface 120 having a centrally positioned circumferential groove 122 therein for the winding of the flat string 34 to the anchor member 100, as shown in FIG. 4. The circumferential groove 122 includes a cut-out flap or slot opening 123 for receiving an end section $S_2$ of flat string 34 therethrough. The proximal end 112 of anchor member 110 includes a pair of opposing U-shaped concave perimeter grooves/edges 124 and 126 for receiving a portion of the user's interdigital space 128. The anchor member 110 is made of a flexible plastic material.

Figure 6:
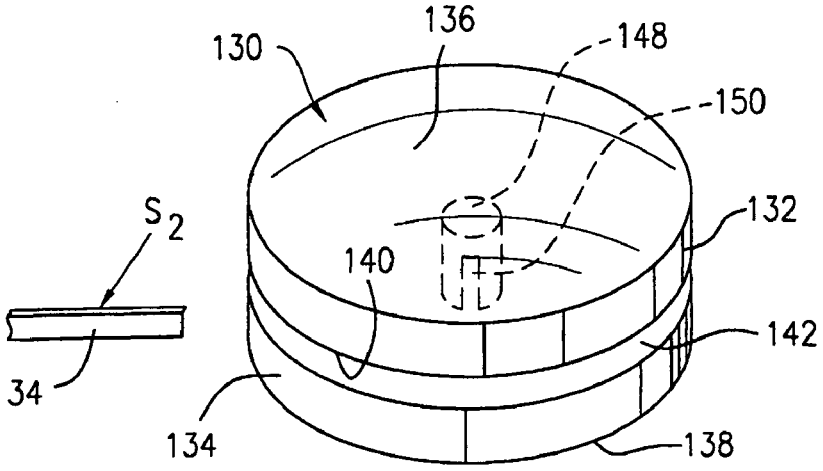
FIG. 6 is an enlarged perspective view of the false nail removal device showing a gripper member and the flat string therein.
Figure 7:
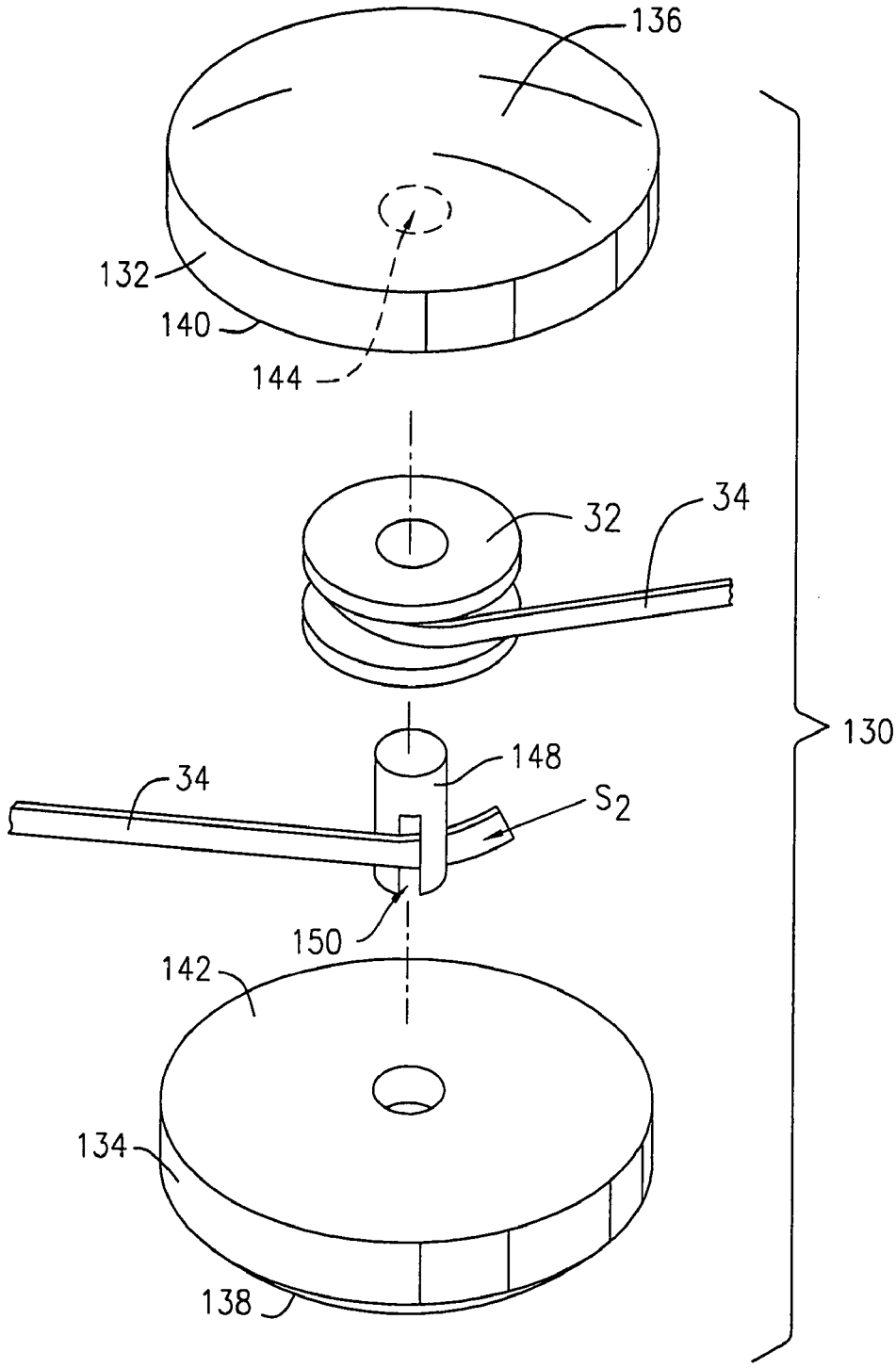
FIG. 7 is an exploded perspective view of the false nail removal device showing a pair of gripper sections and a slotted rod having a string slot therein.

The gripping member 130, as shown in FIGS. 6 and 7, includes a pair of gripper sections 132 and 134. Each of the gripper sections 132, 134 includes an outer surface wall 136, 138 and an inner surface wall 140, 142, respectively, as shown in FIG. 7. Each of the inner surface walls 140, 142 includes a centrally located tab opening 144, 146 for receiving a slotted rod 148 having a string slot 150 therein. The string slot 150 of slotted rod 148 receives an end section $S_2$ of flat string 34 therethrough. The gripping member 130 is also used for storing a supply of the flat string 34 therein. Alternatively, slotted rod 148 can receive and hold a spool member 32 for dispensing and storing a supply of flat string 34 thereto. The gripping member 130 is made of a durable plastic material or lightweight metal materials, such as aluminum or stainless steel.

Figure 4A:
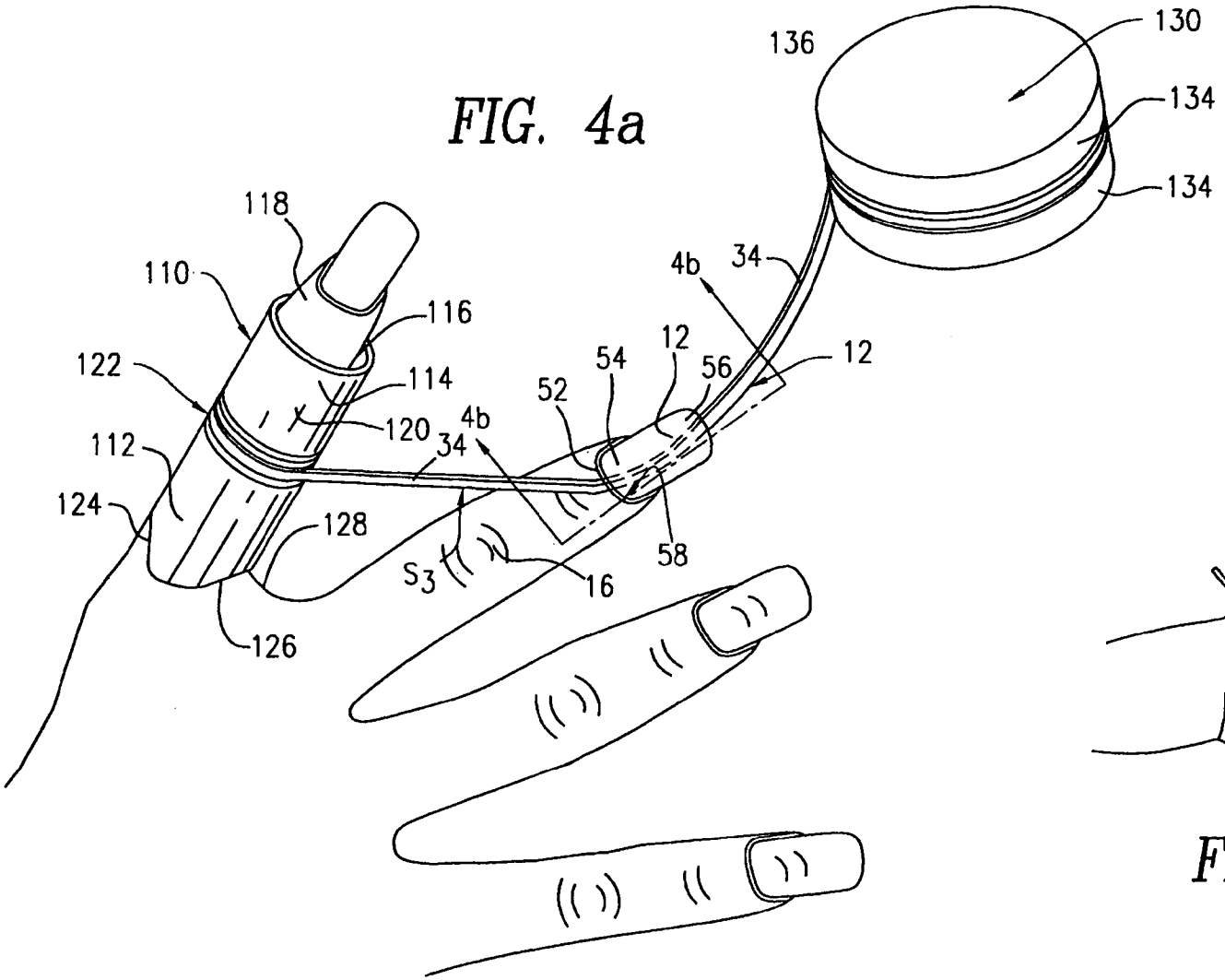
FIG. 4*a* is an enlarged perspective view of the false nail removal device showing a taut string section ($S_3$) between an anchor member and a gripping device with pressure being applied to one side of a base section of a false nail.
Figure 4B:
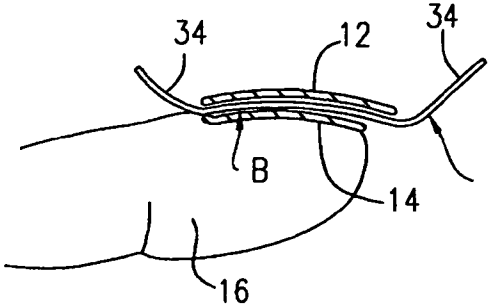
FIG. 4*b* is a cross-sectional view of the false nail removal device taken along lines 4*b*—4*b* of FIG. 4*a* in the direction of the arrows showing the flat string separating the false nail from a user's natural fingernail.

In operation, as shown in FIGS. 4, 4*a* and 4*b*, the operator uses the false nail removal device 100 in a similar manner to the false nail removal device 10 of the preferred embodiment, except that in the initial step, the taut string section $S_3$ of flat string 34 is placed to one side $54_s$ of the base section 43 of false nail 12 in order to engage the base section 54 in order to remove the false nail 12. The remaining steps of operation are exactly the same as with the preferred embodiment 10 of the present invention.

SECOND ALTERNATE EMBODIMENT

Figure 8:
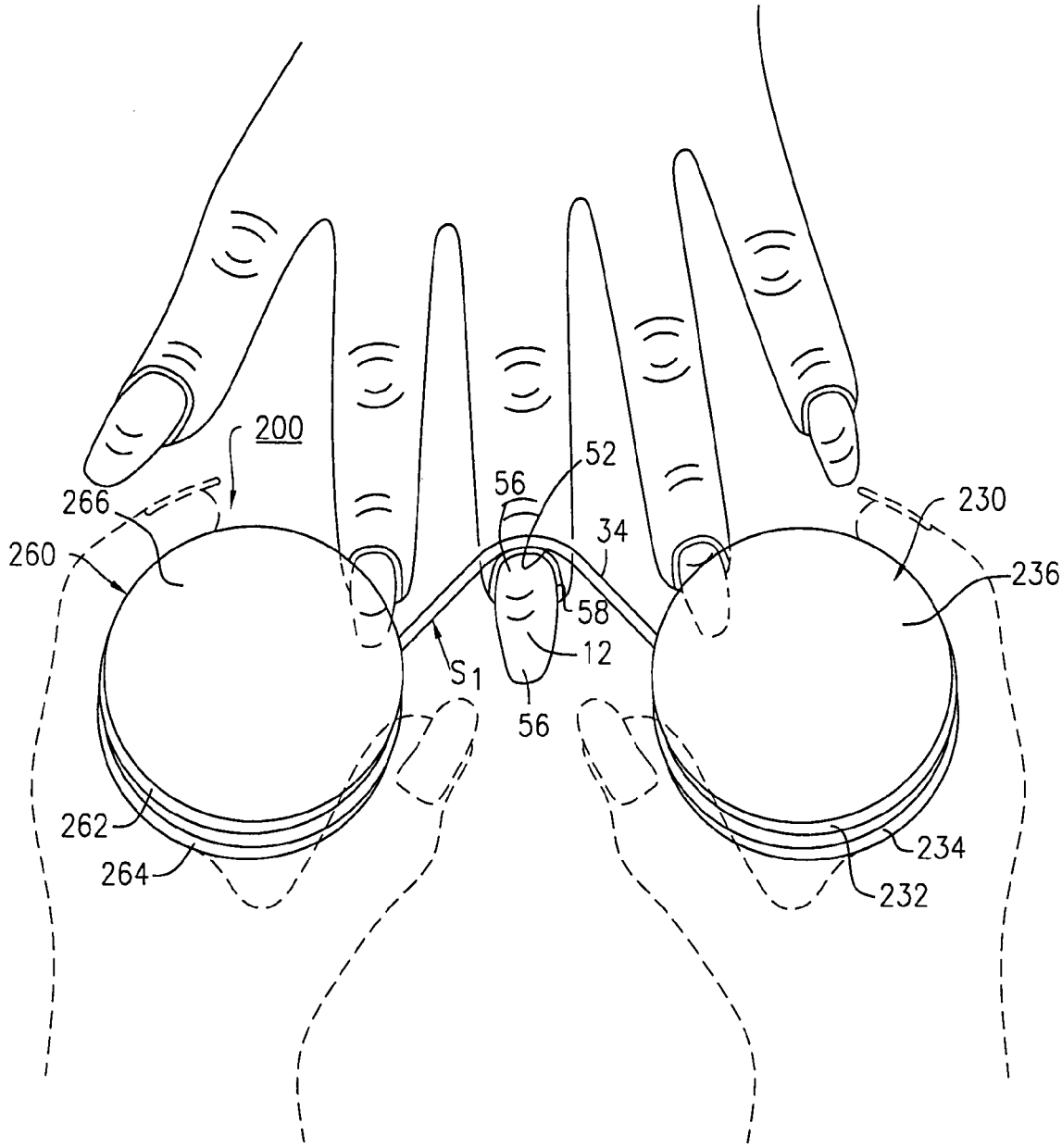
FIG. 8 is a top perspective view of the false nail removal device of the second alternate embodiment of the present invention showing the device in an assembled state and in an operational mode.
Figure 9:
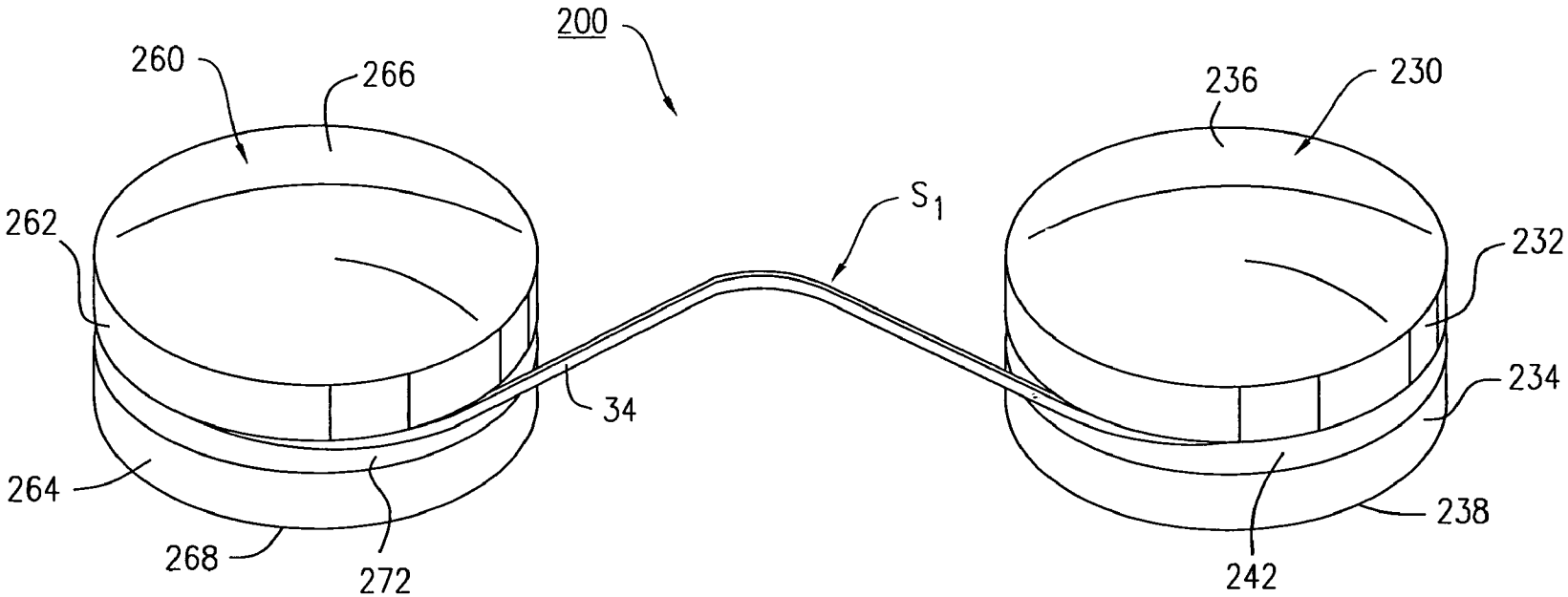
FIG. 9 is an enlarged perspective view of the false nail removal device showing each of the gripper members and the flat string therebetween.
Figure 10:
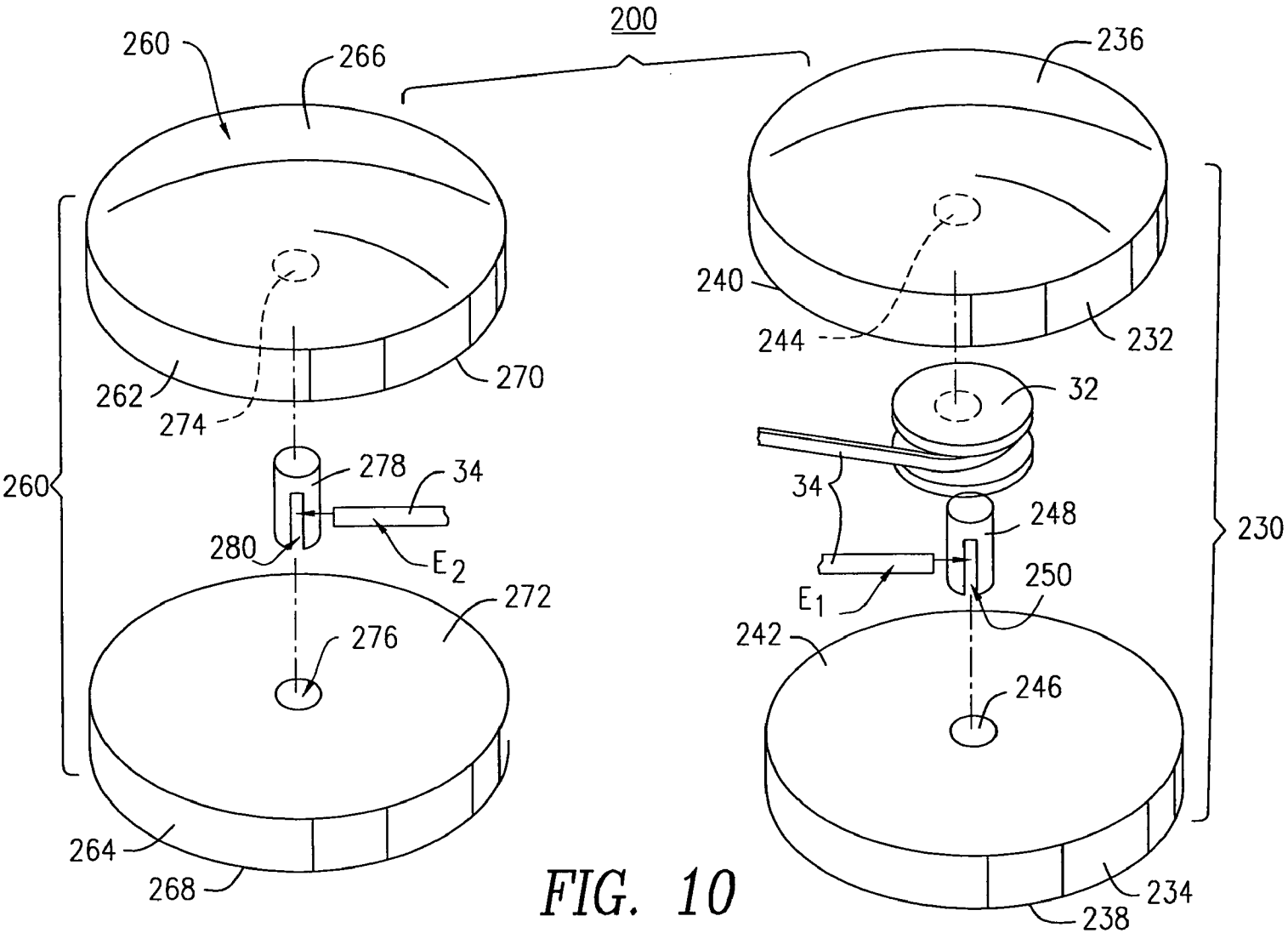
FIG. 10 is an exploded perspective view of the false nail removal device showing a plurality of gripper sections, and a pair of slotted rods each having a string slot therein.

The false nail removal device 200 is for professional use by a manicurist, as shown in FIGS. 8 to 10. The false nail removal device 200 includes a first gripping member 230 and a second gripping member 260 being interconnected by the flat string 34, as shown in FIG. 8. The first gripping member 230, as shown in FIGS. 9 and 10, includes a pair of gripper sections 232 and 234. Each of the gripper sections 232, 234 includes an outer surface wall 236, 238 and an inner surface wall 240, 242, respectively, as shown in FIG. 10. Each of the inner surface walls 240, 242 includes a centrally located tab opening 244, 246 for receiving a slotted rod 248 having a string slot therein. The string slot 250 of slotted rod 248 receives a first end section $E_1$ of flat string 34 therethrough. The first gripping member 230 is also used for storing a supply of flat string 34 therein. Alternatively, slotted rod 248 can receive and hold a spool member 32 for dispensing and storing a supply of flat string 34 thereto.

The second gripping member 260, as shown in FIGS. 9 and 10, includes a pair of gripper sections 262 and 264. Each of the gripper sections 262, 264 includes an outer surface wall 266, 268 and an inner surface wall 270, 272, respectively, as shown in FIG. 10. Each of the inner surface walls 270, 272 includes a centrally located tab opening 274, 276 for receiving a slotted rod 278 having a string slot 280 therein. The string slot 280 of slotted rod 278 receives a second end $E_2$ of flat string 34 therethrough.

Each of the gripping members 230 and 260 is made of a lightweight durable plastic or a lightweight metal, such as aluminum.

Figure 8B:
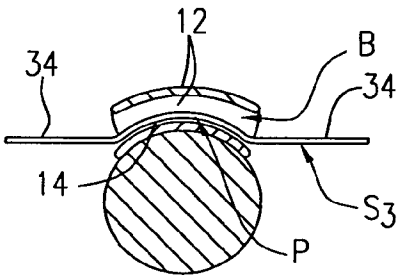
FIG. 8*b* is a cross-sectional view of the false nail removal device taken along lines 8*b*—8*b* of FIG. 8*a* in the direction of the arrows showing the separation of the consumer's false nail from the consumer's natural fingernail using the flat string.
Figure 8A:
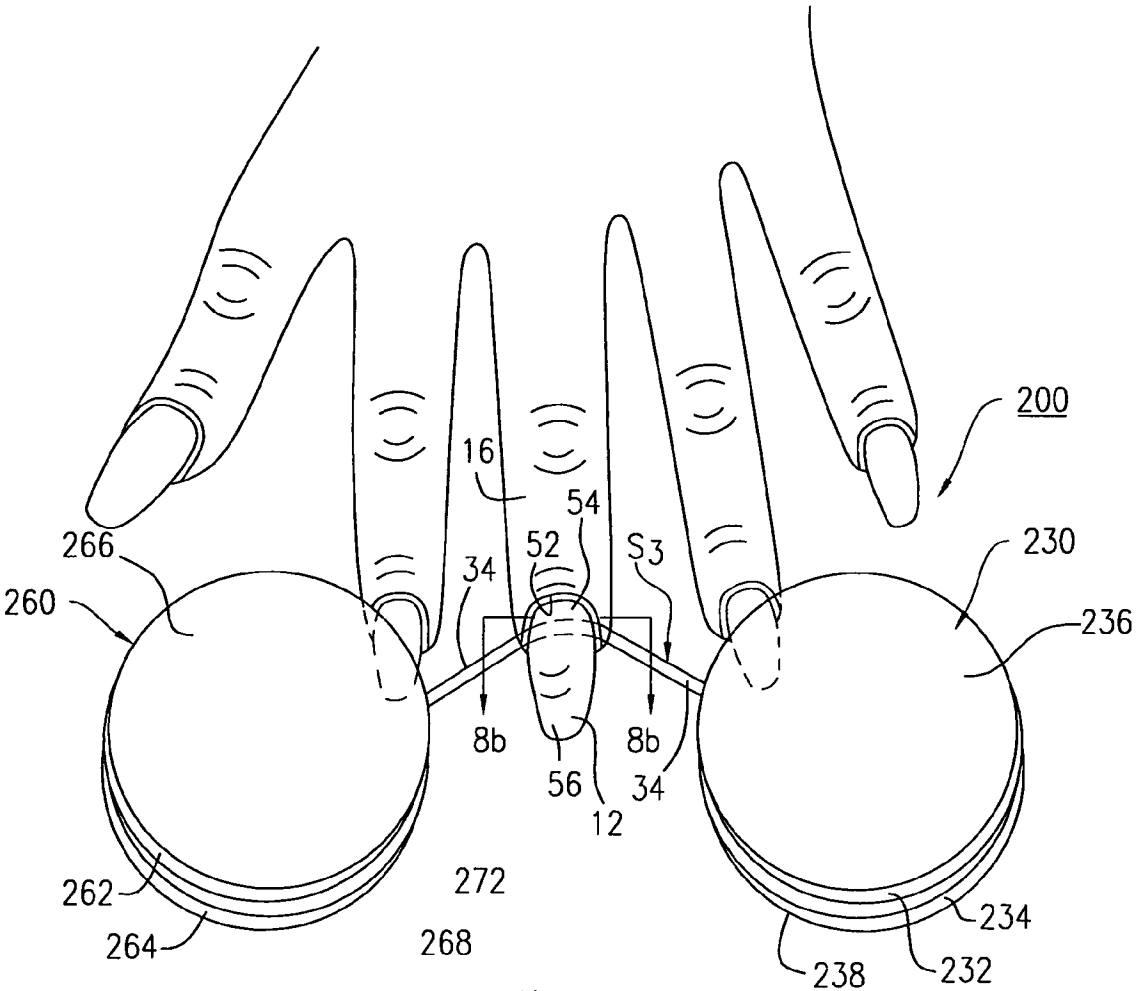
FIG. 8*a* is an enlarged top perspective view of the false nail removal device showing a taut string section ($S_3$) of a flat string between a first gripper member and a second gripper member at a base section of a consumer's false nail.

In operation, as shown in FIGS. 8, 8*a* and 8*b*, the operator uses the false nail removal device 200 in exactly the same manner as the false nail removal device 10 of the preferred embodiment of the present invention. Further, the false nail removal device 200 can be used when the user's hand is facing in a palm upward direction or in a palm downward direction in removing the false nail 12 from the user's natural fingernail 14.

ADVANTAGES OF THE PRESENT INVENTION

Accordingly, an advantage of the present invention is that it provides a false nail removal method and device that permits the user to remove a false nail from a user's natural fingernail without the excessive use of force and without the use of harmful chemical solvents.

Another advantage of the present invention is that it provides for a false nail removal method and device that is not harmful to the user's natural fingernail during the removal of the false nail.

Another advantage of the present invention is that it provides for a false nail removal method and device that is time efficient, cost effective and easy to use. Salons, manicurists, and operators will increase productivity which will increase profitability of their operations.

Another advantage of the present invention is that it provides for a false nail removal method and device that is painless, effortless, convenient and quick when removing a false nail.

Another advantage of the present invention is that it provides for a false nail removal method and device that is capable of removing false nails that have been bonded to the user's natural fingernail by glue, cement gels, acrylics, adhesives and the like.

Another advantage of the present invention is that it provides for a false nail removal method and device that is capable of being used over and over again.

A further advantage of the present invention is that it provides for a false nail removal method and device that can be mass produced in an automated and economical manner and is readily affordable to the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A method of removing a false nail from a person's natural fingernail comprising, the steps of:

a) pushing the cuticle away from the base of the false nail to expose the base of the false nail;

b) placing a taut string to engage the base of the false nail to be removed;

c) applying pressure to the base of the false nail using said taut string to break part of the adhesive bond between the false nail and the person's natural fingernail; and d) manipulating said taut string between the false nail and the natural fingernail by moving said taut string from the base of the false nail toward the tip of the false nail in order to continue to break the adhesive bond between the false nail and the natural fingernail in order to remove the false nail.

2. A method in accordance with claim 1, wherein said step of placing includes a flat string for engaging the base of the false nail to be removed.

3. A method in accordance with claim 1, wherein said step of manipulating said taut string between the false nail and the natural fingernail is performed by zigzag movement of said taut string from the base of the false nail toward the tip of the false nail in order to break the bond between the false nail and the natural fingernail in order to remove the false nail.

4. A method in accordance with claim 1, further including the step of orienting the person's hand in a palm upward direction in order to apply further leverage to the base of the false nail using said taut string to break the adhesive bond between the false nail and the person's natural fingernail.

5. A method in accordance with claim 1, further including the step of unwinding said taut string from a dispensing means in order to disperse an unused portion of said taut string after the completion of multiple false nail removals.

6. A method of removing a false nail from a person's natural fingernail comprising, the steps of:

a) pushing the cuticle away from one side section of the false nail to expose said one side section of the false nail;

b) placing a taut string to engage said one side section of the false nail to be removed;

c) applying pressure to said one side section of the false nail using said taut string to break part of the adhesive bond between the false nail and the person's natural fingernail; and d) manipulating said taut string between the false nail and the natural fingernail by moving said taut string from said one side section of the false nail toward the tip and then toward the other side section of the false nail in order to continue to break the adhesive bond between the false nail and the natural fingernail in order to remove the false nail.

7. A method in accordance with claim 6, wherein said step of placing includes a flat string for engaging said one side section of the false nail to be removed.

8. A method in accordance with claim 6, wherein said step of manipulating said taut string between the false nail and the natural fingernail is performed by zigzag movement of said taut string from said one side section of the false nail toward the tip and the other side section of the false nail in order to break the bond between the false nail and the natural fingernail in order to remove the false nail.

9. A method in accordance with claim 6, further including the step of orienting the person's hand in a palm upward direction in order to apply further leverage to said one side section of the false nail using said taut string to break the adhesive bond between the false nail and the person's natural fingernail.

10. A method in accordance with claim 6, further including the step of unwinding said taut string from a dispensing means in order to disperse an unused portion of said taut string after the completion of multiple false nail removals.

* * * * *